US010183503B2

(12) United States Patent
Yoshinuma et al.

(10) Patent No.: US 10,183,503 B2
(45) Date of Patent: Jan. 22, 2019

(54) DRYING DEVICE AND PRINTING APPARATUS

(71) Applicants: Toshihiro Yoshinuma, Kanagawa (JP); Yasuhisa Katoh, Kanagawa (JP); Junji Nakai, Kanagawa (JP); Hirokazu Ikenoue, Tokyo (JP); Sho Sawahata, Tokyo (JP); Ken Onodera, Kanagawa (JP)

(72) Inventors: Toshihiro Yoshinuma, Kanagawa (JP); Yasuhisa Katoh, Kanagawa (JP); Junji Nakai, Kanagawa (JP); Hirokazu Ikenoue, Tokyo (JP); Sho Sawahata, Tokyo (JP); Ken Onodera, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/598,794

(22) Filed: May 18, 2017

(65) Prior Publication Data

US 2017/0334217 A1 Nov. 23, 2017

(30) Foreign Application Priority Data

May 19, 2016 (JP) ..... 2016-100763

(51) Int. Cl.
*B41J 11/02* (2006.01)
*B41J 11/00* (2006.01)
*F26B 3/28* (2006.01)

(52) U.S. Cl.
CPC ..... *B41J 11/0015* (2013.01); *B41J 11/002* (2013.01); *F26B 3/28* (2013.01)

(58) Field of Classification Search
CPC combination set(s) only.
See application file for complete search history.

(56) References Cited

U.S. PATENT DOCUMENTS 7,832,852 B2 * 11/2010 Leighton ..... B41J 11/002 347/102
8,534,825 B2 * 9/2013 Leighton ..... B41J 11/002 347/102

(Continued)

FOREIGN PATENT DOCUMENTS

JP 5-008373 1/1993
JP 5-297557 11/1993

(Continued)

*Primary Examiner* — Matthew Luu
*Assistant Examiner* — Lily Kemathe
(74) *Attorney, Agent, or Firm* — Oblon, McClelland, Maier & Neustadt, L.L.P.

(57) ABSTRACT

A drying device includes a first heater, a second heater, a conveyance path, and an infrared heater. The first heater contacts and heats a medium on which liquid is applied. The second heater contacts and heats the medium. The second heater contacts the medium at a distance longer than a distance at which the first heater contacts the medium. The conveyance path of the medium includes a first conveyance-path portion and a second conveyance-path portion. The medium is conveyed while contacting the first heater in the first conveyance-path portion. The first conveyance-path portion is disposed upstream from the second heater in a direction of conveyance of the medium. The second conveyance-path portion is disposed downstream from the second heater in the direction of conveyance of the medium. The infrared heater is disposed in the second conveyance-path portion, to irradiate an infrared ray to the medium.

18 Claims, 9 Drawing Sheets

(56) References Cited

U.S. PATENT DOCUMENTS

| | | | | |
|---|---|---|---|---|
| 9,233,557 | B2 * | 1/2016 | Hoshina | B41J 11/0015 |
| 9,605,900 | B2 | 3/2017 | Boland et al. | |
| 2009/0021550 | A1 * | 1/2009 | Leighton | B41J 11/002 347/17 |
| 2009/0297245 | A1 * | 12/2009 | Godden | B41F 23/0403 400/611 |
| 2012/0154498 | A1 * | 6/2012 | Chiwata | B41J 11/0015 347/102 |
| 2014/0232797 | A1 | 8/2014 | Onodera et al. | |
| 2015/0174921 | A1 | 6/2015 | Onodera et al. | |
| 2016/0101635 | A1 * | 4/2016 | Hoshino | B41J 11/002 347/102 |
| 2016/0263914 | A1 | 9/2016 | Hoshino | |
| 2016/0273832 | A1 | 9/2016 | Asada et al. | |
| 2017/0173974 | A1 * | 6/2017 | Hoshino | B41J 11/0015 |

FOREIGN PATENT DOCUMENTS

| | | |
|---|---|---|
| JP | 2000-019877 | 1/2000 |
| JP | 2003-237049 | 8/2003 |
| JP | 2010-036589 | 2/2010 |
| JP | 2010-204235 | 9/2010 |
| JP | 2013-039721 | 2/2013 |
| JP | 2014-152964 | 8/2014 |
| JP | 2016-107519 | 6/2016 |

* cited by examiner

DRYING DEVICE AND PRINTING APPARATUS

CROSS-REFERENCE TO RELATED APPLICATION

This patent application is based on and claims priority pursuant to 35 U.S.C. § 119(a) to Japanese Patent Application No. 2016-100763,filed on May 19, 2016 in the Japan Patent Office, the entire disclosure of which is hereby incorporated by reference herein.

BACKGROUND

Technical Field

Embodiments of the present disclosure relate to a drying device and a printing apparatus.

Related Art

As a printing apparatus to apply liquid to a continuous sheet or the like to perform printing, for example, an apparatus is known that applies liquid to a continuous sheet or the like and then dries the liquid with a heater.

SUMMARY

In an aspect of the present disclosure, there is provided a drying device that includes a first heater, a second heater, a conveyance path, and an infrared heater. The first heater contacts and heats a medium on which liquid is applied. The second heater contacts and heats the medium. The second heater contacts the medium at a distance longer than a distance at which the first heater contacts the medium. The conveyance path of the medium includes a first conveyance-path portion and a second conveyance-path portion. The medium is conveyed while contacting the first heater in the first conveyance-path portion. The first conveyance-path portion is disposed upstream from the second heater in a direction of conveyance of the medium. The second conveyance-path portion is disposed downstream from the second heater in the direction of conveyance of the medium. The infrared heater is disposed in the second conveyance-path portion, to irradiate an infrared ray to the medium.

In another aspect of the present disclosure, there is provided a drying device that includes a plurality of heaters, a conveyance path, and an infrared heater. The plurality of heaters contacts and heats a medium on which liquid is applied. The plurality of heaters is arrayed in a direction of conveyance of the medium. The conveyance path includes a first conveyance-path portion and a second conveyance-path portion. The medium is conveyed while contacting the plurality of heaters in the first conveyance-path portion. In the second conveyance-path portion, the medium is conveyed while contacting again the plurality of heaters which the medium has contacted in the first conveyance-path portion. The infrared heater irradiates an infrared ray to the medium in the second conveyance-path portion, to heat the medium.

In still another aspect of the present disclosure, there is provided a printing apparatus that includes a liquid application device and the drying device according to any of the above-described aspect. The liquid application device applies the liquid to the medium. The drying device dries the medium on which the liquid is applied.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
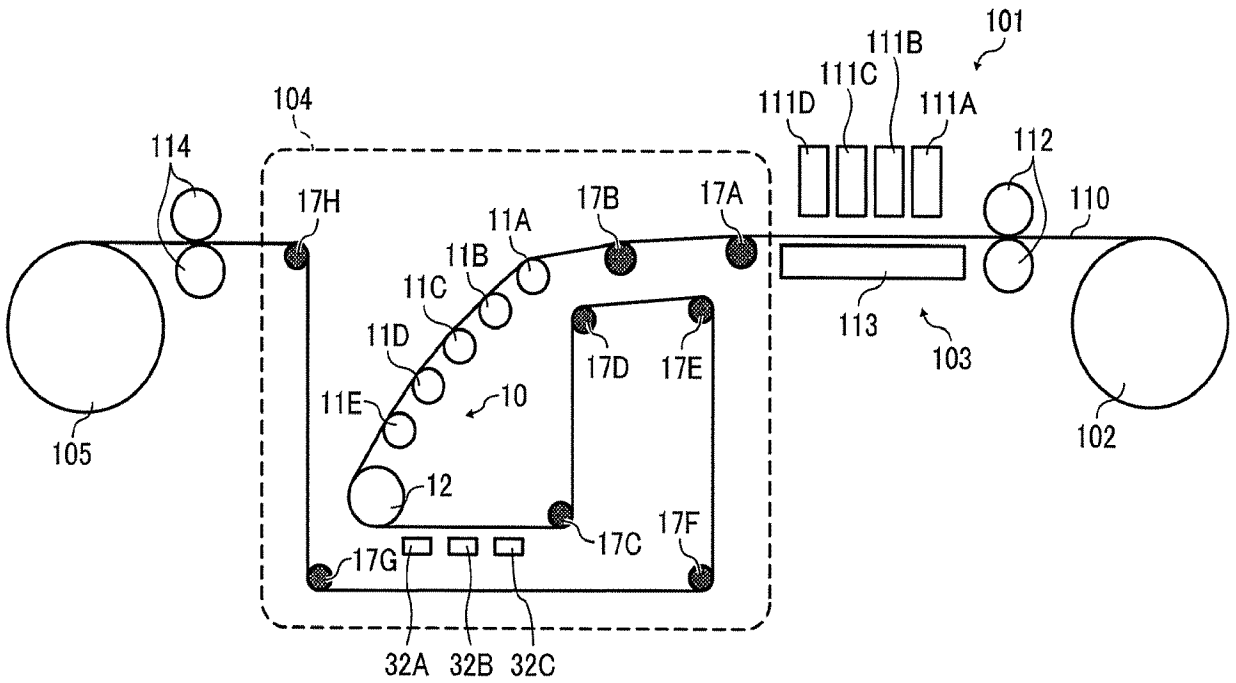
FIG. 1 is a schematic view of a printing apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, wherein like reference numerals designate identical or corresponding parts throughout the several views, embodiments of the present disclosure are described below. First, a printing apparatus according to a first embodiment of the present disclosure is described with reference to FIG. 1. FIG. 1 is a schematic view of the printing apparatus according to the first embodiment.

The printing apparatus is an inkjet recording apparatus, and includes a liquid application unit 101 including a liquid discharge head, which is a liquid application device, to discharge and apply ink, which is a color liquid, onto a continuous sheet 110, which is a medium (or member) to be conveyed.

In the liquid application unit 101, for example, full-line heads 111A, 111B, 111C, and 111D (referred to as "heads 111" unless colors distinguished) of four colors are disposed in this order from the upstream side in a direction D of conveyance of the continuous sheet 110. The heads 111 respectively applies liquids of black (K), cyan (C), magenta (M), and yellow (Y) onto the continuous sheet 110. Note that the number and types of color are not limited to the above-described four colors of K, C, M, and Y and may be any other suitable number and types.

The continuous sheet 110 is fed from a feeding roller 102, is sent onto a conveyance guide 113, which is disposed to face the liquid application unit 101, by a conveyance roller 112 of a conveyance unit 103, and is guided and conveyed (moved) by the conveyance guide 113.

The continuous sheet 110 onto which the liquid is applied by the liquid application unit 101 is sent by an ejection roller 114 through a drying device 104 as a drying device according to the present embodiment, and is wound around a winding roller 105.

Figure 2:
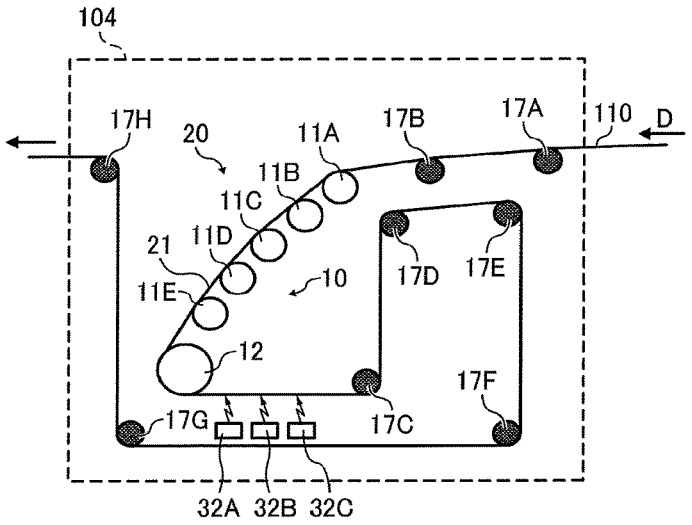
FIG. 2 is an enlarged view of a drying device according to the first embodiment.

Next, the drying device according to the first embodiment is further described with reference to FIGS. 2 and 3. FIG. 2 is an enlarged view of a portion of the drying device. FIGS. 3A and 3B are illustrations of a winding angle with respect to a first heating roller and a heating drum.

The drying device 104 includes a contact heater 10 to heat the continuous sheet 110 in contact with a surface of the continuous sheet 110 on a side opposite to a surface onto which the liquid is applied. The drying device 104 includes guide rollers 17A and 17B to guide the continuous sheet 110 to the contact heater 10, and guide rollers 17C to 17H to guide the continuous sheet 110 that passes through the contact heater 10.

The contact heater 10 includes a plurality of first heating rollers 11A to 11E, which are first heating members, each including a curved contact face 11*a* to contact the continuous sheet 110, and a heating drum 12, which is a second heating member, including a curved contact face 12*a* to also contact the continuous sheet 110. The first heating rollers 11A to 11E may have different diameters. In the present embodiment, all of the first heating rollers 11A to 11E and the heating drum 12 are rollers.

The plurality of first heating rollers 11A to 11E (hereinafter, referred to as a first "heating rollers 11" unless distinguished, which is also applied to other members) and the heating drum 12 are disposed in an arcuate (or circular arc) arrangement along the direction D of conveyance of the continuous sheet 110.

A conveyance path (conveyance route) 20 formed by the plurality of first heating rollers 11, the heating drum 12, and the plurality of guide rollers 17 includes a first conveyance-path portion 21 at which the continuous sheet 110 contacts the first heating rollers 11 on an upstream side from the heating drum 12 being the second heating member.

Figure 3A:
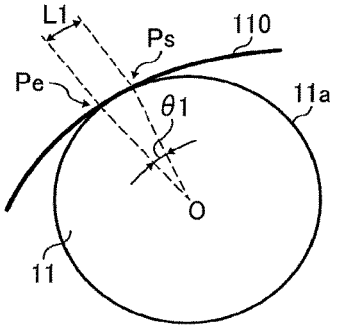
FIGS. 3A and 3B are illustrations of a winding angle with respect to a first heating roller and a heating drum.
Figure 3B:
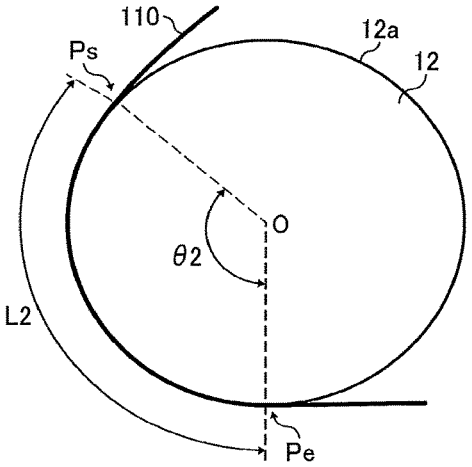

As illustrated in FIGS. 3A and 3B, the conveyance path 20 is configured such that a contact distance L2 between the contact face 12*a* of the heating drum 12 and the continuous sheet 110 is longer than a contact distance L1 between the contact face 11*a* of each of the first heating rollers 11A to 11E and the continuous sheet 110.

Here, a winding angle θ2 of the continuous sheet 110 with respect to the contact face 12*a* of the heating drum 12 is greater than a winding angle θ1 of the continuous sheet 110 with respect to the contact face 11*a* of the first heating roller 11 (θ2>θ1).

As illustrated in FIGS. 3A and 3B, the winding angles θ2 and θ1 (collectively referred to as "winding angle θ") indicate angles of a point Ps at which the contact of the continuous sheet 110 with the contact faces 12*a* and 11*a* starts and a point Pe at which the contact of the continuous sheet 110 with the contact faces 12*a* and 11*a* ends, with respect to a center O.

Therefore, in a case where the winding angle θ increases, the contact distance also increases insofar as rotary bodies have the same diameter, and even in a case where the winding angles θ are identical to each other, the contact distance increases as the diameter of the rotary body increases.

In the present embodiment, the diameter of the heating drum 12 is greater than the diameter of the first heating roller 11, and the winding angle θ2 is greater than the winding angle θ1, and thus, in any case, the contact distance L2 between the contact face 12*a* of the heating drum 12 and the continuous sheet 110 is longer than the contact distance L1 between the contact face 11*a* of the first heating roller 11 and the continuous sheet 110.

As described above, even in a case where the winding angles θ are identical to each other, the contact distance increases as the diameter of the rotary body increases. Therefore, by setting the heating drum 12 and the first heating roller 11 to have the same diameter, and the winding angle θ2 to be greater than the winding angle θ1, the contact distance L2 between the contact face 12*a* of the heating drum 12 and the continuous sheet 110 is longer than the contact distance L1 between the contact face 11*a* of the first heating roller 11 and the continuous sheet 110.

As described above, the conveyance path 20 is configured so that the contact distance L2 between the contact face 12*a* of the heating drum 12 and the continuous sheet 110 is longer than the contact distance L1 between the contact face 11*a* of the first heating roller 11 and the continuous sheet 110. Such a configuration can reduce cockling and increase the drying efficiency.

For example, in a state where a time does not elapse from the liquid application, the strength of the continuous sheet 110 decreases. Accordingly, it may be difficult to bring the continuous sheet 110 on a rear surface side closely into contact with a circumferential surface (a contact face) of the rotary body in a wide range (a long contact distance).

Hence, in an initial state in which the applied liquid is not dried, the winding angle θ of the continuous sheet 110 with respect to the first heating roller 11 decreases, and thus, the contact distance is shortened.

Here, by increasing the curvature of the first heating roller 11, a tensile force generated at the time of conveying the continuous sheet 110 is changed to a pressing force in a contact portion with the first heating roller 11, and thus, a contact state with respect to the first heating roller 11 becomes even. In such a state, cockling or wrinkles do not occur on the continuous sheet 110, and when the continuous sheet 110 passes through the first heating roller 11, heat required for evenly drying the liquid on the continuous sheet 110 can be supplied.

Accordingly, the continuous sheet 110 in which the cockling is reduced and the drying is performed, can closely contact the contact face even in a case where the contact distance with respect to the rotary body increases. In particular, the diameter of the first heating roller 11 is set to be less than or equal to 100 mm, which can reliably reduce the cockling.

Therefore, in the heating drum 12 disposed downstream from the first heating roller 11, the contact distance with respect to the continuous sheet 110 increases, and thus, it is possible to supply heat to the continuous sheet 110 for a short period of time, to improve the drying efficiency, and to perform the drying for a short period of time.

The number of first heating rollers 11 to contact the continuous sheet 110 increases, and a drying heat quantity increases, and thus, it is possible to increase a drying rate even in a case of a thick continuous body, and to ensure high productivity.

In the present embodiment, first infrared heaters 32A to 32C are disposed on a downstream side from the heating drum 12 as the second heating member. Each of the first infrared heaters 32A to 32C is an infrared heater (infrared-radiation (IR):far-infrared heater) to irradiate infrared rays having a maximum wavelength (peak wavelength) within an absorption wavelength band of a solvent contained in the liquid. As the infrared heater, for example, a carbon heater using carbon as a material of heat generator or a moderate-wavelength infrared heater to radiate infrared rays of moderate wavelengths may be used.

In the present embodiment, the peak wavelength of infrared rays irradiated by each of the first infrared heaters 32 is within a wavelength band of from 3 μm to 8 μm.

As described above, the first infrared heaters 32 to irradiate infrared rays to evaporate a solvent contained in liquid is disposed on the downstream side from the heating drum 12. Such a configuration can irradiate infrared rays after the heating drum 12 applies a sufficient heat amount to the continuous sheet 110.

Accordingly, when evaporation is performed on a solvent that has a higher boiling point than water and requires a greater energy than an energy for evaporating water, the temperature of the continuous sheet more is more easily raised by irradiation of infrared rays. Thus, the solvent can be more effectively evaporated, thus increasing the drying efficiency. Such increase of the drying efficiency allows an increase in conveyance speed of the continuous sheet, thus increasing the productivity.

Figure 4:
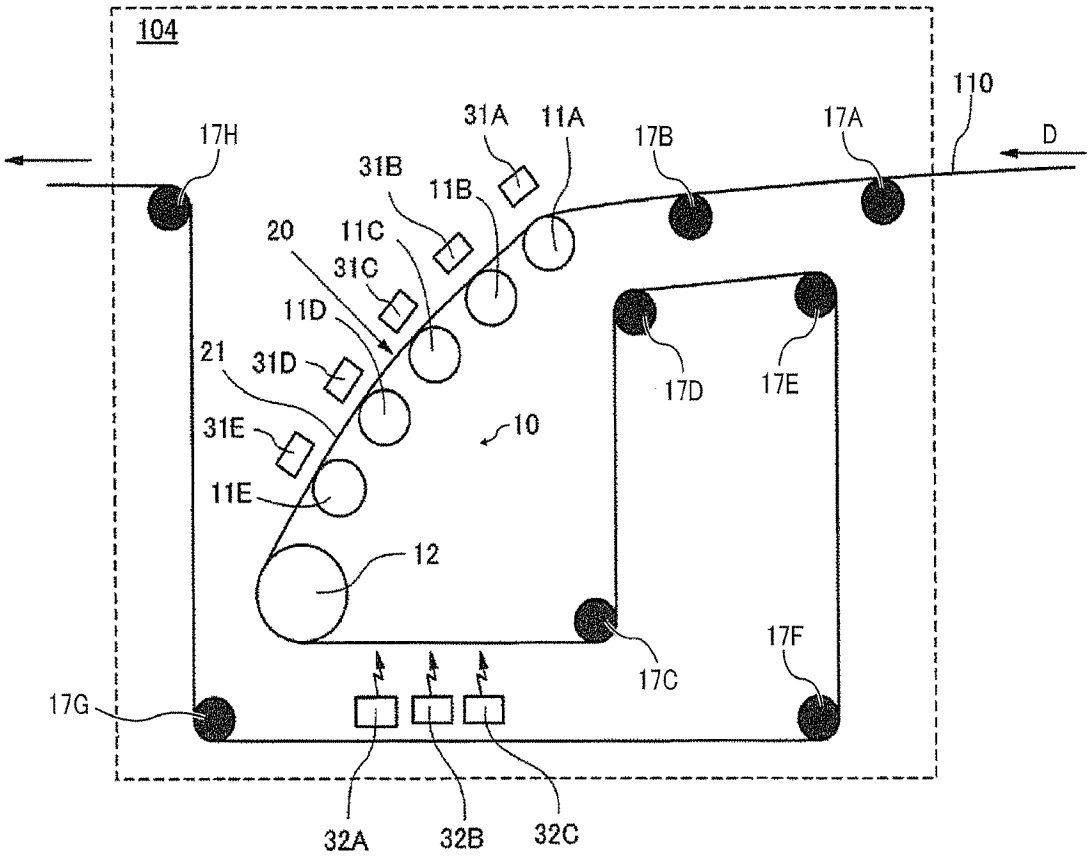
FIG. 4 is an enlarged view of the drying device according to a second embodiment of the present disclosure.

Next, the drying device according to a second embodiment of the present disclosure is described with reference to FIG. 4. FIG. 4 is an enlarged view of the drying device.

In the second embodiment, a plurality of second infrared heaters 31A to 31E are disposed in the first conveyance-path portion 21. Each of the second infrared heaters 31A to 31E is an infrared heater (infrared-radiation (IR):far-infrared heater) to irradiate, toward the first heating rollers 11, infrared rays having a maximum wavelength (peak wavelength) within an absorption wavelength band of water contained in the liquid.

In the present embodiment, the peak wavelength of infrared rays irradiated by each of the second infrared heaters 31 is within a wavelength band of from 2 μm to 6 μm. Water has absorption peak wavelengths of 2 μm, 3 μm, and 6 μm when the moisture amount is low. Irradiation of infrared rays of peak wavelengths matching the absorption peak wavelengths can increase the drying efficiency.

Therefore, the peak wavelength of the infrared ray irradiated by the plurality of second infrared heaters 31 can be set to be gradually or stepwisely longer toward the downstream side.

The second infrared heaters 31 are arranged to irradiate infrared rays toward the first heating rollers 11. Irradiating infrared rays toward points at which the continuous sheet 110 winds around the first heating rollers 11 can prevent the temperature of the continuous sheet 110 from being rapidly raised by the heatsink effect of the first heating rollers 11, thus reducing damage to the continuous sheet 110.

As described above, the heating by infrared rays irradiated from the second infrared heaters 31 is used together the heating by the first heating rollers 11. Such a configuration can evaporate the moisture of liquid applied to the continuous sheet 110 for a shorter period of time, thus increasing the drying speed. Therefore, such a configuration can further increase the conveyance speed of the continuous sheet, thus more increasing the productivity than in the first embodiment.

Figure 5:
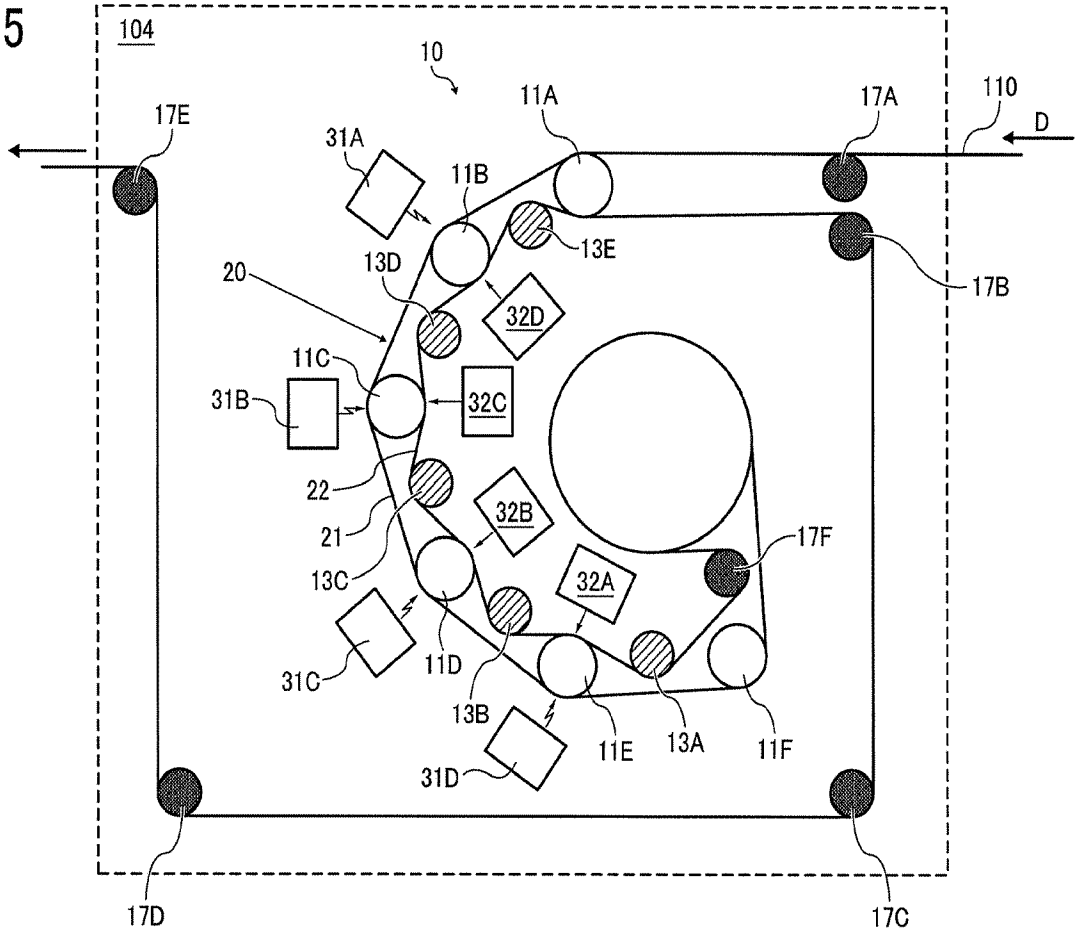
FIG. 5 is an enlarged view of the drying device according to a third embodiment of the present disclosure.
Figure 6:
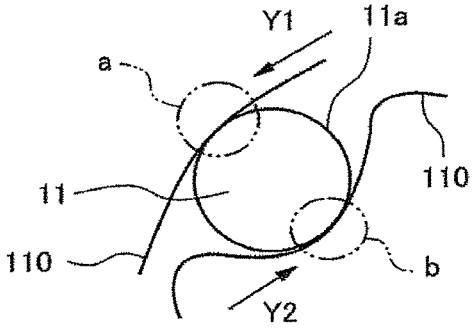
FIG. 6 is an illustration of a state of contact with the first heating roller in the third embodiment.

Next, the drying device according to the third embodiment of the present disclosure is described with reference to FIG. 5 and FIG. 6. FIG. 5 is an enlarged view of the drying device. FIG. 6 is an illustration of a contact state of the continuous sheet with the first heating roller.

The drying device 104 includes the contact heater 10 to heat the continuous sheet 110 in contact with a surface of the continuous sheet 110 on a side opposite to a surface onto which the liquid is applied. The drying device 104 includes a guide roller 17A to guide the continuous sheet 110 to the contact heater 10, and guide rollers 17B to 17E to guide the continuous sheet 110 that passes through the contact heater 10.

Similarly with the above-described embodiments, the contact heater 10 in the present embodiment includes the first heating rollers 11A to 11F as the plurality of first heating members and the heating drum 12. The contact heater 10 further includes a plurality of contact guider rollers 13A to 13E and a guide roller 17F. The contact guider rollers 13A to 13E as contact guides to guide the continuous sheet 110 so that the continuous sheet 110 contacts the first heating rollers 11E, 11D, 11C, 11B, and 11A. The guide roller 17F guides the continuous sheet 110 from the heating drum 12 to the contact guide roller 13A.

In the present embodiment, the first heating rollers 11A to 11F are disposed in a curved arrangement. Each of the contact guide rollers 13 is disposed between adjacent ones of the first heating rollers 11.

A conveyance path (conveyance route) 20 formed by the plurality of first heating rollers 11, the heating drum 12, and the plurality of guide rollers 17 includes a first conveyance-path portion 21 and a second conveyance-path portion 22. At the first conveyance-path portion 21, the continuous sheet 110 contacts the first heating rollers 11 on an upstream side from the heating drum 12. At the second conveyance-path portion 22, the continuous sheet 110 contacts the first heating rollers 11 on a downstream side from the heating drum 12 as the second heating member.

In other words, as illustrated in FIG. 6, the conveyance path 20 includes a route in which, after the continuous sheet 110 is conveyed in a first direction (Y1 direction) while contacting the plurality of first heating rollers 11, the continuous sheet 110 is turned around by, e.g., the heating drum 12 and is conveyed in a second direction (Y2 direction) opposite the first direction while contacting the plurality of first heating rollers 11 again.

In the present embodiment, the conveyance path is a route in which the continuous sheet 110 contacts two or more first heating rollers 11 when the continuous sheet 110 is conveyed in the Y2 direction. However, in some embodiments, for example, the conveyance path may be a route in which the continuous sheet 110 contacts a single first heating roller 11 when the continuous sheet 110 is conveyed in the Y2 direction.

In the present embodiment, on the outer side (a side which receives tension) of the plurality of first heating rollers 11A to 11F disposed in the curved arrangement, the continuous sheet 110 is conveyed in the Y1 direction while contacting the first heating rollers 11A to 11F. Thereafter, the direction of conveyance of the continuous sheet 110 is turned, and the continuous sheet 110 is guided on the inner side (loosening side) of the plurality of first heating rollers 11E to 11A by the contact guide roller 13 and is conveyed in the Y2 direction while contacting the first heating rollers 11E to 11A.

At this time, as illustrated in FIG. 6, the continuous sheet 110 is conveyed in the Y1 direction and the Y2 direction while simultaneously contacting two spaced portions (portion a and portion b) of each of the first heating rollers 11.

As described above, the medium to be conveyed is heated while simultaneously contacting different two portions of the same heating member (the same heating roller). Such a configuration can effectively dry the medium with a relatively small number of heating members.

In the present embodiment, a plurality of second infrared heaters 31A to 31D are disposed in the first conveyance-path portion 21. Each of the second infrared heaters 31A to 31D irradiates, toward the first heating rollers 11B to 11E, infrared rays having a maximum wavelength (peak wavelength) within an absorption wavelength band of water contained in the liquid.

In addition, a plurality of first infrared heaters 32A to 32D are disposed in the second conveyance-path portion 22. Each of the first infrared heaters 32A to 32D irradiates, toward the first heating rollers 11E to 11B, infrared rays having a maximum wavelength (peak wavelength) within an absorption wavelength band of a solvent contained in the liquid.

In other words, the second infrared heaters 31 and the first infrared heaters 32 are arranged to simultaneously irradiate infrared rays having different peak wavelengths at two spaced portions (portion a and portion b) of each of the first heating rollers 11.

Accordingly, as described in the above-described embodiments, the heating by infrared rays irradiated from the second infrared heaters 31 is used together the heating by the first heating rollers 11. Such a configuration can evaporate the moisture of liquid applied to the continuous sheet 110 for a shorter period of time.

The first infrared heaters 32 to irradiate infrared rays to evaporate a solvent contained in liquid is disposed on the downstream side from the heating drum 12, and the infrared rays are irradiated after a sufficient amount of heat is applied to the continuous sheet 110 by the heating drum 12. Such a configuration facilitates the temperature rise of the continuous sheet and allows more efficient evaporation of the solvent, thus enhancing the drying efficiency.

Such an increase of the drying efficiency allows an increase in conveyance speed of the continuous sheet, thus increasing the productivity.

Figure 7:
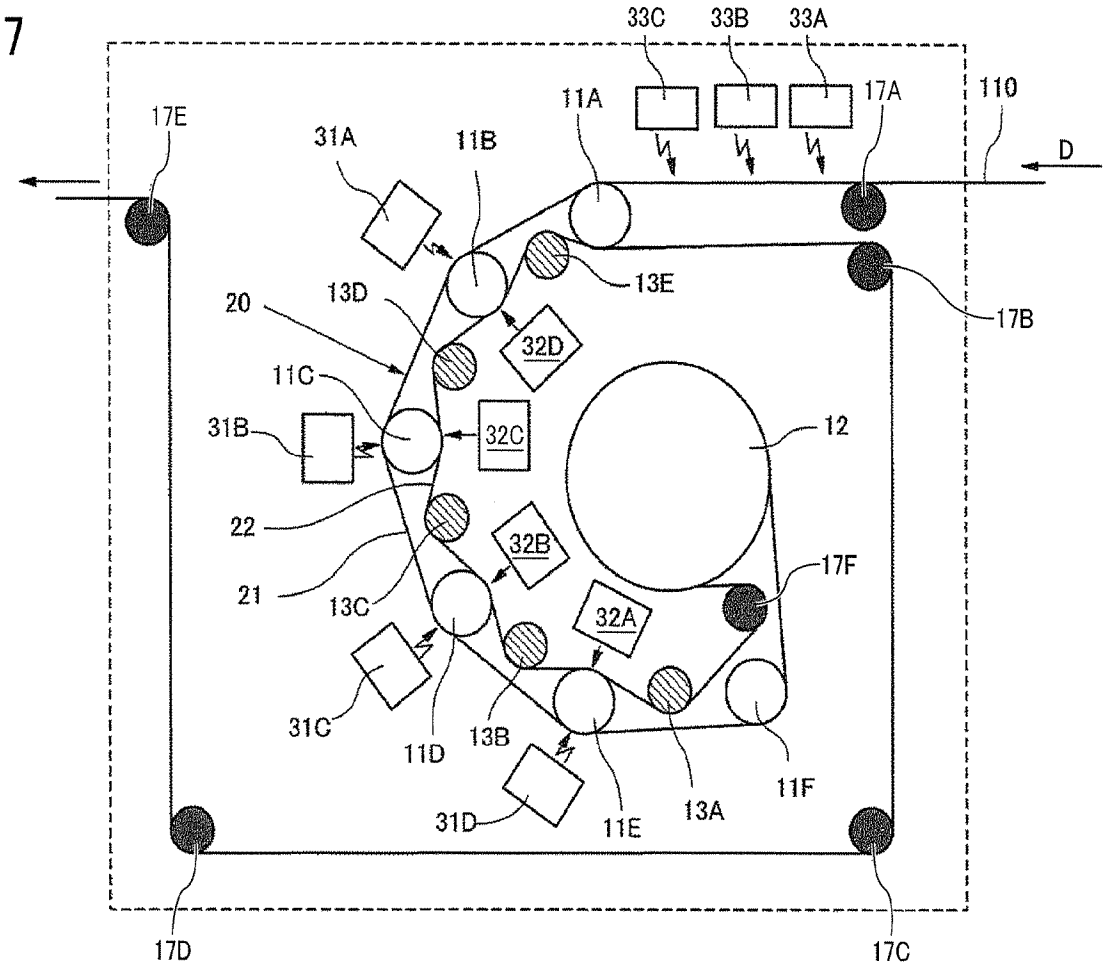
FIG. 7 is an enlarged view of the drying device according to a fourth embodiment of the present disclosure.

Next, the drying device according to a fourth embodiment of the present disclosure is described with reference to FIG. 7. FIG. 7 is an enlarged view of the drying device.

For the fourth embodiment, in the configuration of the above-described third embodiment, a plurality of third infrared heaters 33A to 33C are also disposed upstream from the first heating rollers 11. Each of the third infrared heaters 33A to 33C irradiates infrared rays having a maximum wavelength (peak wavelength) within an absorption wavelength band of water contained in the liquid. The third infrared heaters 33A to 33C have similar configurations to the configurations of the above-described second infrared heaters 31.

Such a configuration can increase the temperature of the continuous sheet 110 on the upstream side from the first heating rollers 11 to enhance the effect of straightening the continuous sheet 110 with the first heating rollers 11.

Figure 8:
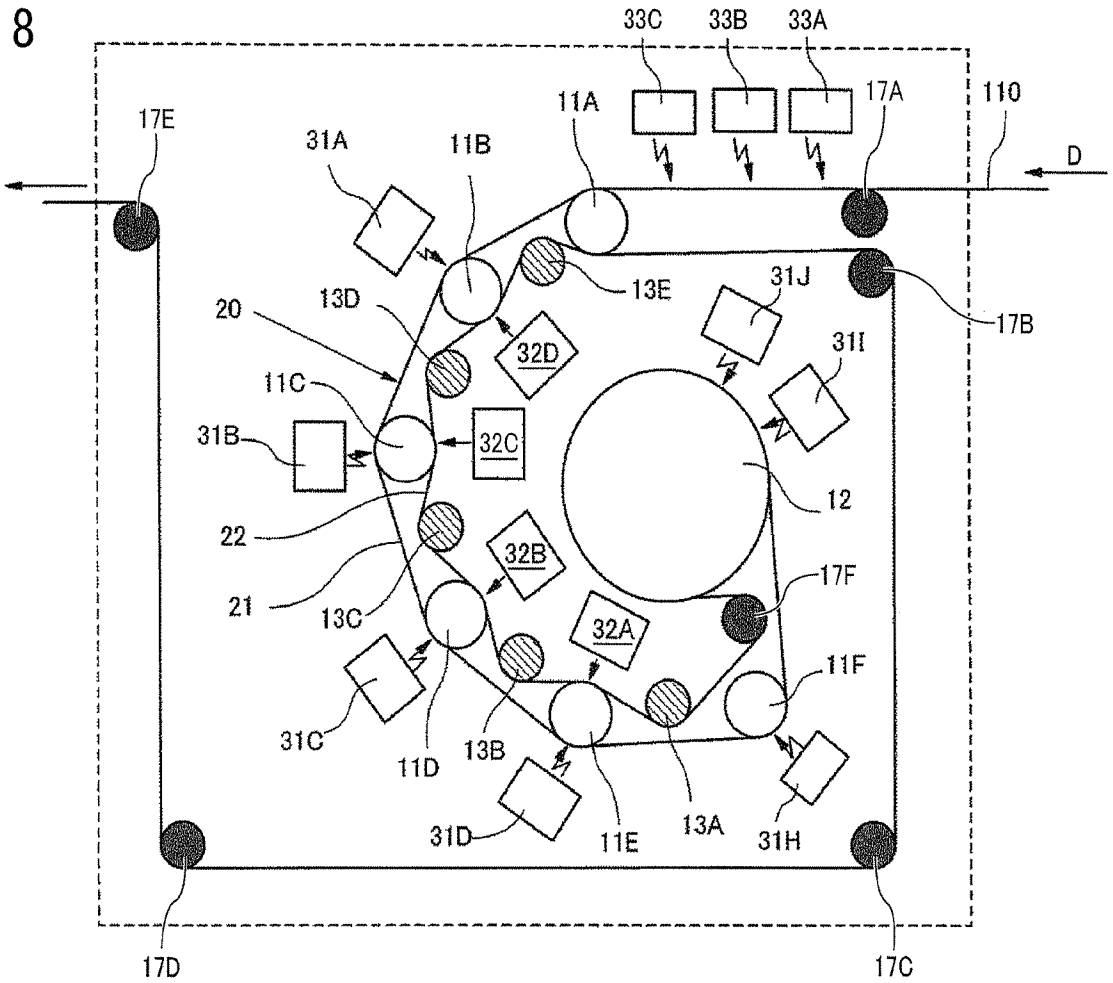
FIG. 8 is an enlarged view of the drying device according to a fifth embodiment of the present disclosure.

Next, the drying device according to a fifth embodiment of the present disclosure is described with reference to FIG. 7. FIG. 8 is an enlarged view of the drying device.

For the fifth embodiment, in the configuration of the above-described third embodiment, a plurality of second infrared heaters 31H to 31J are also disposed opposite the first heating roller 11F and the heating drum 12. Each of the second infrared heaters 31H to 31J irradiates infrared rays having a maximum wavelength (peak wavelength) within an absorption wavelength band of water contained in the liquid.

Such a configuration can further increase the temperature of the continuous sheet 110 at a stage precedent to the second conveyance-path portion 22, thus allowing more prompt evaporation of the solvent.

Figure 9:
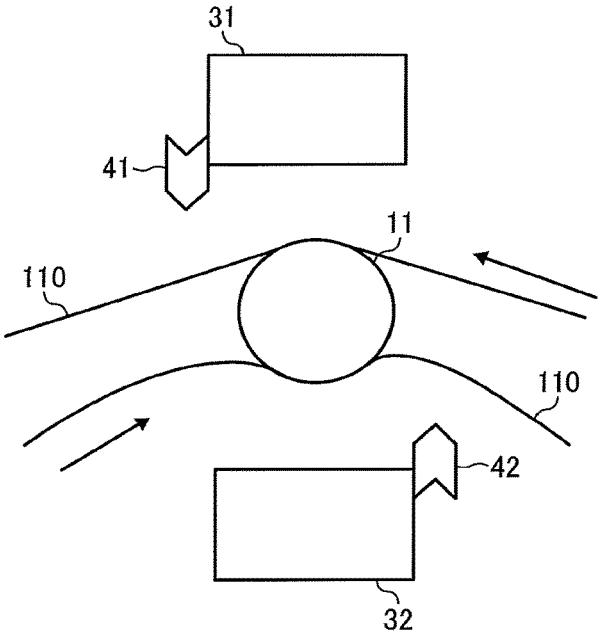
FIG. 9 is an illustration of the arrangement of a temperature sensor in an embodiment of the present disclosure.
Figure 10:
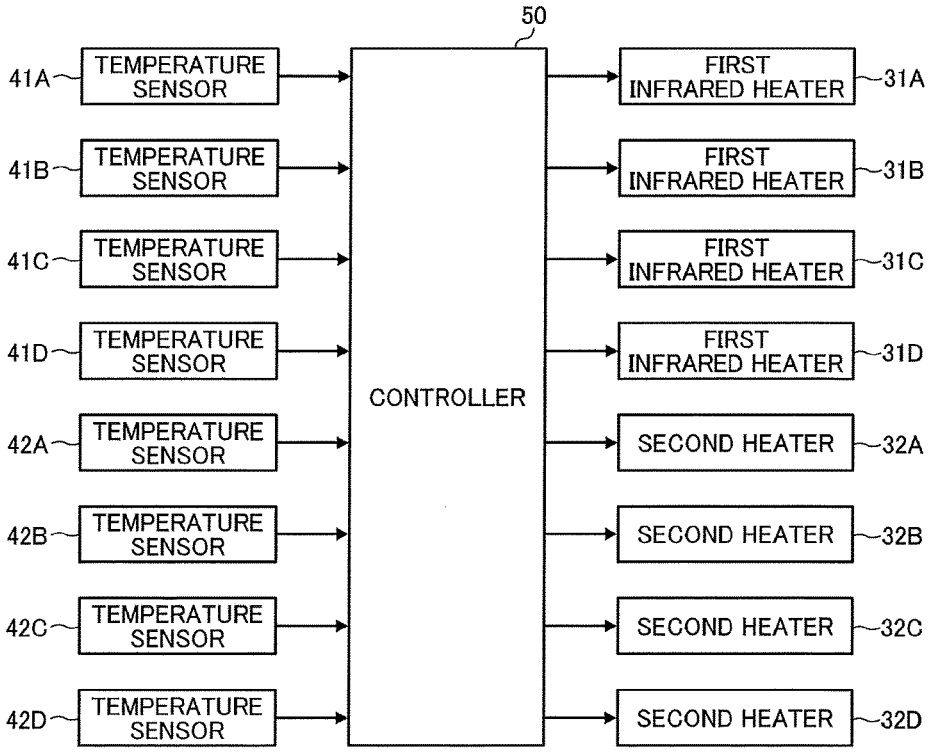
FIG. 10 is a block diagram of a portion relevant to temperature control of an infrared heater in an embodiment of the present disclosure.

Next, the temperature control of the infrared heaters is described with reference to FIGS. 9 and 10. FIG. 9 is an illustration of the arrangement of temperature sensors. FIG. 10 is a block diagram of a portion relating to the temperature control of the infrared heaters.

A temperature sensor 41 (e.g., temperature sensors 41A to 41D in FIG. 10) to detect the temperature of the continuous sheet 110 is disposed at a downstream side of each second infrared heater 31.

A detection signal of the temperature sensor 41 corresponding to each second infrared heater 31 is input to a controller 50. The controller 50 controls the wavelength of an infrared ray irradiated from each second infrared heater 31, according to the detected temperature obtained from the detection signal of the temperature sensor 41.

Similarly, a temperature sensor 42 (e.g., temperature sensors 42A to 42D in FIG. 10) to detect the temperature of the continuous sheet 110 is disposed at a downstream side of each first infrared heater 32.

A detection signal of the temperature sensor 42 corresponding to each first infrared heater 32 is input to the controller 50. The controller 50 controls the wavelength of an infrared ray irradiated from each first infrared heater 32, according to the detected temperature obtained from the detection signal of the temperature sensor 42.

In the second infrared heaters 31 and the first infrared heaters 32, as an input voltage (an application voltage) decreases, the temperature of a heat source decreases and the wavelength of the infrared ray to be irradiated is lengthened.

When drying is performed with the temperature of water raised to a boiling point, evaporation proceeds faster. The temperature of water is not raised to 100° C. or higher.

Hence, when the detected temperature of the continuous sheet 110 detected with the temperature sensor 41 at the downstream side of the second infrared heater 31 is lower than 100° C. (the boiling point of water), the controller 50 controls application power to irradiate an infrared ray having a (short) peak wavelength of 2 μm. By contrast, when the detected temperature is equal to or higher than 100° C., the controller 50 controls the application power to be lowered to irradiate infrared rays of (long) peak wavelengths of 3 μm and 6 μm.

To evaporate the solvent, the temperature is raised to be higher than the boiling point of water (100° C.) (since the boiling point of a solvent contained in ink is 100° C. or higher). When the temperature of paper is raised to 150° C. or higher, damages, such as blister and yellowing, may occur.

Hence, the controller 50 controls the application voltage applied to the first infrared heater 32 such that the detected temperature of the continuous sheet 110 detected with the temperature sensor 42 at the downstream side of the first infrared heater 32 is in a range between 100° C. and 150° C.

Further, in each of the above-described embodiments, the configuration in which the plurality of first heaters are arranged in series is described. However, in some embodiment, a simple roller (rotary body) other than the heater may be disposed between the heaters.

In each of the above-described embodiments, the term "medium" represents a medium or member to be conveyed by the drying device. In the above descriptions, an example has been described in which the medium to be conveyed is a continuous sheet. However, the medium to be conveyed is not limited to the continuous sheet. For example, the medium may be a printed object, such as a sheet for electronic circuit board (e.g., prepreg), and wallpaper, as well as a continuous body, such as a continuous sheet, a roll sheet, and a web, and a recording medium (printed object) such as an elongated sheet material.

On the medium that is conveyed, not only is an image, such as characters or figures, recorded with liquid, such as ink, by a printing apparatus but also a meaningless image, such as a pattern, may be applied for decoration or the like.

Herein, the liquid to be applied to the medium is not particularly limited. However, the liquid may preferable have a viscosity of 30 mPa·s or less under a normal temperature and pressure or under heating or cooling. Examples of the liquid include a solution, a suspension, or an emulsion including, for example, a solvent, such as water or an organic solvent, a colorant, such as dye or pigment, a polymerizable compound, a resin, a functional material, such as a surfactant, a biocompatible material, such as DNA, amino acid, protein, or calcium, and an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

When a liquid discharge head is used as the liquid application device, examples of an energy generation source to discharge liquid include an energy generation source using a piezoelectric actuator (a lamination-type piezoelectric element and a thin-film piezoelectric element), a thermal actuator using an electrothermal transducer element, such as a heating resistor (heating element), a static actuator including a diaphragm plate and opposed electrodes, and the like.

Herein, the printing has the same meaning as the meaning of image formation, recording, printing, imprinting, and the like.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A drying device comprising:

a first heater to contact and heat a medium on which liquid including water and a solvent is applied;

a second heater to contact and heat the medium, the second heater contacting the medium at a distance longer than a distance at which the first heater contacts the medium;

a conveyance path of the medium including:

a first conveyance-path portion in which the medium is conveyed while contacting the first heater, the first conveyance-path portion disposed upstream from the second heater in a direction of conveyance of the medium; and a second conveyance-path portion disposed downstream from the second heater in the direction of conveyance of the medium;

a first infrared heater disposed in the first conveyance-path portion and that radiates a first infrared ray to the medium, a maximum wavelength of the first infrared ray that the first infrared heater radiates being in an absorption wavelength band of the water; and a second infrared heater disposed in the second conveyance-path portion and that radiates a second infrared ray to the medium, a maximum wavelength of the second infrared ray that the second infrared heater radiates being in an absorption wavelength band of the solvent.

2. The drying device according to claim 1, wherein the maximum wavelength of the second infrared ray that the second infrared heater radiates is in a wavelength band of from 3 μm to 8 μm.

3. The drying device according to claim 1, wherein the second conveyance-path portion includes a route on which the medium is conveyed while contacting again the first heater which the medium has contacted in the first conveyance-path portion.

4. The drying device according to claim 3, further comprising a contact guide disposed in the second conveyance-path portion, to guide the medium to contact the first heater.

5. The drying device according to claim 3, further comprising a plurality of first heaters, including the first heater, to contact and heat the medium, the plurality of first heaters arrayed in the direction of conveyance of the medium, wherein the plurality of first heaters is disposed in a curved or arcuate arrangement, wherein, in the first conveyance-path portion, the medium is conveyed along an outer circumferential side of the plurality of first heaters disposed in the curved or arcuate arrangement, and wherein, in the second conveyance-path portion, the medium is conveyed along an inner circumferential side of the plurality of first heaters disposed in the curved or arcuate arrangement.

6. The drying device according to claim 5, further comprising a plurality of contact guides disposed in the second conveyance-path portion, to guide the medium to contact the plurality of first heaters.

7. The drying device according to claim 6, wherein each of the plurality of contact guides is disposed between adjacent ones of the plurality of first heaters.

8. The drying device according to claim 1, wherein the maximum wavelength of the first infrared ray that the first infrared heater radiates is in a wavelength band of from 2 μm to 6 μm.

9. The drying device according to claim 1, further comprising a third infrared heater disposed upstream from the first heater in the direction of conveyance of the medium and that radiates a third infrared ray to the medium.

10. The drying device according to claim 9, wherein a maximum wavelength of the third infrared ray that the third infrared heater radiates is in the absorption wavelength band of the water that is included in the liquid.

11. The drying device according to claim 9, wherein a maximum wavelength of the third infrared ray that the third infrared heater radiates is in a wavelength band of from 2 μm to 6 μm.

12. The drying device according to claim 1, further comprising a plurality of other infrared heaters, including said first infrared heater, that each radiate an infrared ray to the medium, the plurality of other infrared heaters disposed along the direction of conveyance of the medium in the first conveyance-path portion, wherein a more downstream one of the plurality of other infrared heaters in the direction of conveyance of the medium radiates an infrared ray having a longer peak wavelength than a more upstream one of the plurality of other infrared heaters.

13. A printing apparatus comprising:

a liquid application device to apply the liquid to the medium; and the drying device according to claim 1, to dry the medium on which the liquid is applied.

14. A drying device comprising:

a plurality of heaters to contact and heat a medium on which liquid including water and a solvent is applied, the plurality of heaters arrayed in a direction of conveyance of the medium;

a conveyance path including:

a first conveyance-path portion in which the medium is conveyed while contacting the plurality of heaters; and a second conveyance-path portion in which the medium is conveyed while contacting again the plurality of heaters, which the medium has contacted in the first conveyance-path portion;

a first infrared heater disposed in the first conveyance-path portion and that radiates a first infrared ray to the medium, a maximum wavelength of the first infrared ray that the first infrared heater radiates being in an absorption wavelength band of the water; and a second infrared heater disposed in the second conveyance-path portion and that radiates a second infrared ray to the medium, a maximum wavelength of the second infrared ray that the second infrared heater radiates being in an absorption wavelength band of the solvent.

15. The drying device according to claim 14, further comprising another heater disposed downstream from the plurality of heaters in the first conveyance-path portion and upstream from the plurality of heaters in the second conveyance-path portion in the direction of conveyance of the medium, wherein said another heater contacts the medium at a longer distance than a distance at which each of the plurality of heaters contacts the medium.

16. The drying device according to claim 14, wherein the maximum wavelength of the second infrared ray that the second infrared heater radiates is in a wavelength band of from 3 μm to 8 μm.

17. The drying device according to claim 1, further comprising a controller configured to control the first infrared heater and the second infrared heater to respectively radiate the first infrared ray and the second infrared ray.

18. The drying device according to claim 14, further comprising a controller configured to control the first infrared heater and the second infrared heater to respectively radiate the first infrared ray and the second infrared ray.

* * * * *